US008122569B2

(12) United States Patent
Paul

(10) Patent No.: US 8,122,569 B2
(45) Date of Patent: Feb. 28, 2012

(54) AUXILIARY HANDLE FOR HAND-HELD POWER TOOL

(75) Inventor: Martin Paul, Karlsruhe (DE)

(73) Assignee: Hilti Aktiengesellschaft, Schaan (LI)

( * ) Notice: Subject to any disclaimer, the term of this patent is extended or adjusted under 35 U.S.C. 154(b) by 246 days.

(21) Appl. No.: 12/584,911

(22) Filed: Sep. 14, 2009

(65) Prior Publication Data

US 2010/0064481 A1 Mar. 18, 2010

(30) Foreign Application Priority Data

Sep. 15, 2008 (DE) ..... 10 2008 042 111

(51) Int. Cl.
*B25G 1/10* (2006.01)
*A45C 13/26* (2006.01)

(52) U.S. Cl. ..... 16/426; 16/422; 16/436

(58) Field of Classification Search ..... 016/426, 016/408, 429, 436; 294/58; 408/124, 241 R; 173/161, 162.1, 162.2; 81/177.6, 177.7, 81/177.8, 177.9

See application file for complete search history.

(56) References Cited

U.S. PATENT DOCUMENTS

| | | | | |
|---|---|---|---|---|
| 6,499,172 | B1 | 12/2002 | McCracken | |
| 2002/0125022 | A1 * | 9/2002 | Dieterle et al. | 173/170 |
| 2004/0163214 | A1 | 8/2004 | Cheng | |
| 2007/0209162 | A1 * | 9/2007 | McRoberts et al. | 16/426 |
| 2009/0178520 | A1 * | 7/2009 | Engelfried et al. | 81/489 |

FOREIGN PATENT DOCUMENTS

| | | | |
|---|---|---|---|
| GB | 2444169 | A * | 5/2008 |
| JP | 09109065 | A * | 4/1997 |
| JP | 2000176864 | A * | 6/2000 |

* cited by examiner

*Primary Examiner* — Chuck Y. Mah

(74) *Attorney, Agent, or Firm* — Abelman, Frayne & Schwab

(57) ABSTRACT

An auxiliary handle for a hand-held power tool (7) includes an attachment section (21) for securing the auxiliary handle (11) on a section (8) of the power tool (7) a gripping member (31) for holding the auxiliary handle (11), a lag hinge (46) provided between the attachment section (21) and the gripping member (34), and including a locking member (52) pivotable about an axis (53) extending parallel to the axis (12) of the lag hinge (46) between its locking position in which it blocks the lag hinge (46), and a release position thereof in which the lag hinge (46) is released.

6 Claims, 3 Drawing Sheets

AUXILIARY HANDLE FOR HAND-HELD POWER TOOL

BACKGROUND OF THE INVENTION

1. Field of the Invention

The present invention relates to an auxiliary handle for a hand-held power tool such as a power drill, a hammer drill or a chisel hammer and includes an attachment section for securing the auxiliary handle on a section of the power tool and having an articulation section, a gripping member for holding the auxiliary handle and having at least one bearing section, a lockable lag hinge provided between the attachment section and the gripping member and having a pivot axis, and a locking device for locking and releasing the lag hinge.

2. Description of the Prior Art

In power tools, auxiliary handles of the type described above are provided, if needed, in form of a side handle mounted, e.g., on a housing section adjacent to a tool holder for guiding the power tool. It is known to form a gripping member of the auxiliary handle pivotable about a pivot axis in order to optimally guide the power tool and to enable different griping positions of the auxiliary handle on the power tool, which would insure a less tiring operation. A lag hinge provides for a pivotal movement of the gripping member relative to the attachment section of the auxiliary handle. The pivoting of the gripping member permits to adjust the gravity point of the power tool with respect to the tool user. Often, the gripping member is adjusted during the power tool use. German Publication DE 10 2006 055 524 A1 discloses an auxiliary handle for a hand-held power tool and having its attachment section formed as a clamping sleeve for mounting the auxiliary handle on a section of the power tool. The attachment section also includes an articulation section. The auxiliary handle also includes a gripping member for grasping and holding the auxiliary handle and having spaced from each other bearing sections. Between the attachment section and the gripping member, a lockable lag hinge is arranged. The lag hinge has a pivot pin a longitudinal axis of which forms the pivot axis of the lag hinge. The bearing sections of the gripping member and the articulation section of the attachment section are provided, in the region where their respective contact surface contact each other, respectively, with toothing and counter-toothing which form a locking device and which lock the lag hinge when the toothing and counter-toothing formlockingly engage each other, and which release the lag hinge in their disengaged condition. The auxiliary handle is locked or released with an operational knob that forms a locking member and is arranged on one end of the pivot pin of the lag hinge, being secured on a section of the pivot pin provided with an outer thread, with the locking device being displaced in its locking or release position, respectively.

The drawback of the above-described auxiliary handle consists in that for releasing the lag hinge, the engaging each other elements of the locking device should be spaced from each other by at least the height of the teeth so that the gripping member can be pivoted relative to the attachment section. This requires several revolutions of the locking member which, in turn, increases the time necessary for adjustment.

Further, during release of the lag hinge, the locking and, thus, fixation of the attachment section of the auxiliary handle on the power tool can also be loosen, and the auxiliary handle, which is mounted on the power tool, can automatically pivot about an operational axis defined by a working tool. Therefore, with a new locking of the lag hinge, additionally, a proper orientation of the entire auxiliary handle relative to the power tool should be carefully readjusted.

Accordingly, an object of the present invention is an auxiliary handle for a hand-held power tool in which the above-discussed drawbacks of a known auxiliary handle are eliminated.

Another object of the present invention is an auxiliary handle for a hand-held power tool and that would enable a simple and rapid pivoting of the gripping member.

SUMMARY OF THE INVENTION

These and other objects of the present invention, which will become apparent hereinafter, are achieved by providing a locking device including a locking member pivotable about an axis extending parallel to the axis of the lag hinge between a locking position in which it locks the lag hinge, and a release position in which the lag hinge is released.

The pivot axis of the lag hinge, e.g., corresponds to a longitudinal axis of a pivot pin that extends, at least partially, through the articulation section of the attachment section and at least one bearing section of the gripping member.

Thereby, the articulation section and the at least one bearing section, through which the pivot pin extends, form articulation sleeves of the lag hinge. The blocking or release of the lag hinge is carried out by pivoting the locking member about its axis. The axis is formed by, e.g., a support pin provided in a pivot point and a longitudinal axis of which extends parallel to the pivot axis of the lag hinge. The function of the auxiliary handle, which is associated with pivotability of the gripping member relative to the operational direction, is completely detached from other functions of the auxiliary handle.

Thus, the lag hinge locking device is completely independent from the locking device of the auxiliary handle, so that for pivoting the gripping member, the locking device of the auxiliary handle need not be released any more. In particular, with an auxiliary handle that is locked by an operational element acting in the direction of the pivot axis, the use of the inventive locking device for locking the lag hinge is advantageous. After the gripping member has been pivoted about a pivot axis in a desired position relative to the power tool, the locking member is pivoted toward the pivot axis in its locking position so that the release condition of the lag hinge is eliminated, and the lag hinge is locked again.

Advantageously, the locking member includes a safety element for securing the locking member in the locking position. The safety element prevents and inadvertent release of the locking device. The safety element is advantageously formed as a locking element such as a cam or projection that engages in a complementary locking element such as a groove or recess for securing the locking member in its locking position.

Advantageously, the locking member is supported on the articulation section of the attachment section. This provides for an advantageous manufacturing of the locking device and, thereby, of the auxiliary handle. In its locking position, the locking member engages a section of the at least one bearing section of the gripping member, preventing an inadvertent pivotal movement of the gripping member relative to the attachment section of the auxiliary handle during operation or transportation of the power tool.

According to an alternative embodiment, the locking member is arranged on the at least one bearing section of the gripping member. In this case, the locking member engages, in its locking position, a section of the articulation section of the attachment section, locking the lag hinge.

Advantageous, the locking member includes locking means that cooperates, in the locking position of the locking member, with counter-locking means provided on the at least one bearing section of the gripping member. Thereby, a form-locking connection between these elements of the auxiliary handle becomes available. This connection enables transmission of the large forces. In the alternative embodiment described above, the counter-locking means is provided on the bearing section of the gripping member.

Advantageously, the articulation section of the attachment section is likewise provided with counter-locking means with which the locking means of the locking member cooperates in the locking position of the locking member. The resulting formlocking connection permits to transmit larger forces between the elements of the auxiliary handle in the locking position of the locking member than at a frictional connection between the elements of the auxiliary handle.

Advantageously, the locking means of the locking member has elevations in form of cams and the counter-locking means of the articulation section and of the at least one bearing section have corresponding recesses for receiving the cams. This insures an advantageous connection in the locking position of the locking member. With the articulation section of the attachment section and the at least one bearing section of the gripping member being provided with counter-locking means in form of recesses, the locking means, which is formed as cams or elevations, advantageously is so arranged on the locking member that the locking means is capable of engaging in the counter-locking means in different positions of the gripping member relative to the attachment section.

Advantageously, the counter-locking means of both the articulation section of attachment section and of the at least one bearing section of the gripping member have a plurality of locking element radially circumferentially spaced from each other and provided in a grid. The grid determines the stepwise pivotability of the gripping member relative to the attachment section. Advantageously, the locking means on the locking member also has locking elements spaced from each other and arranged in a grid corresponding to the grid of the counter-locking elements.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

In the drawings, the same parts are designated with the same reference numerals.

DETAILED DESCRIPTION OF THE PREFERRED EMBODIMENT

Figure 1:
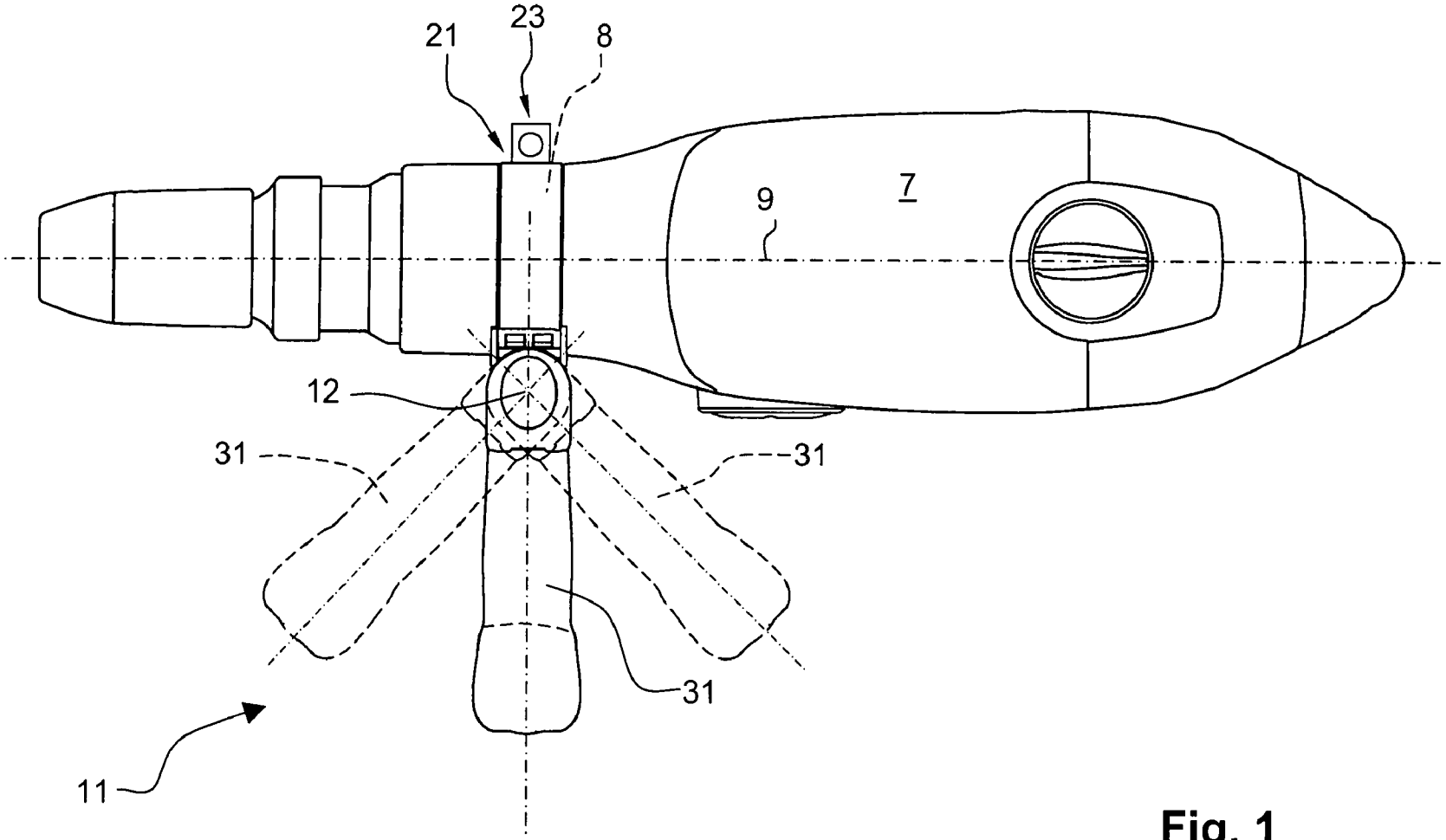
FIG. 1 a plan view of a hand-held power tool with an auxiliary handle according to the present invention.
Figure 2:
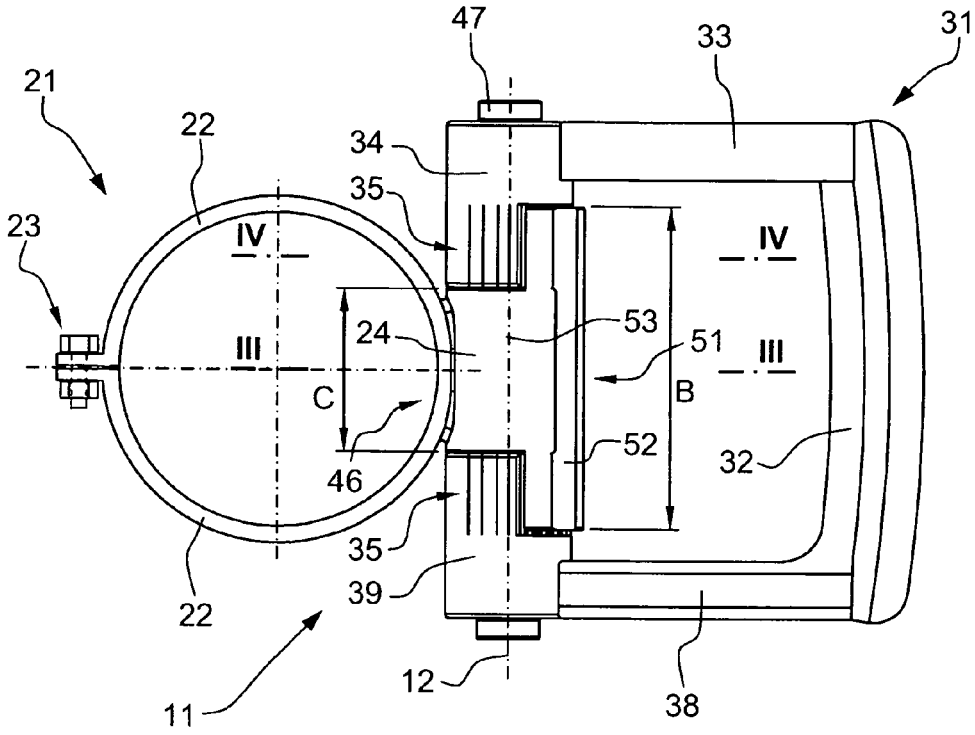
FIG. 2 a side view of the auxiliary handle according to the present invention.
Figure 3A:
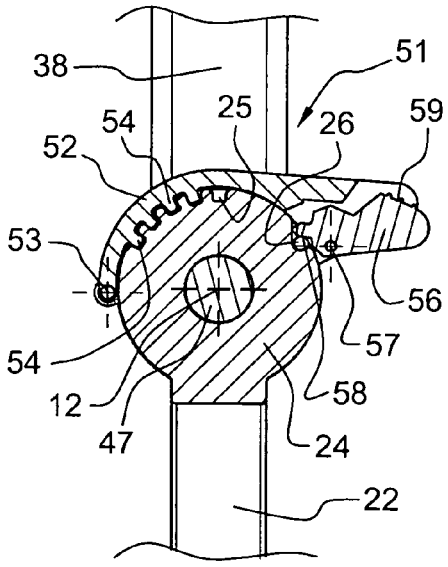
FIG. 3*a* a cross-sectional view along line III-III in FIG. 2 of auxiliary handle with the locking device in the locking position.
Figure 3B:
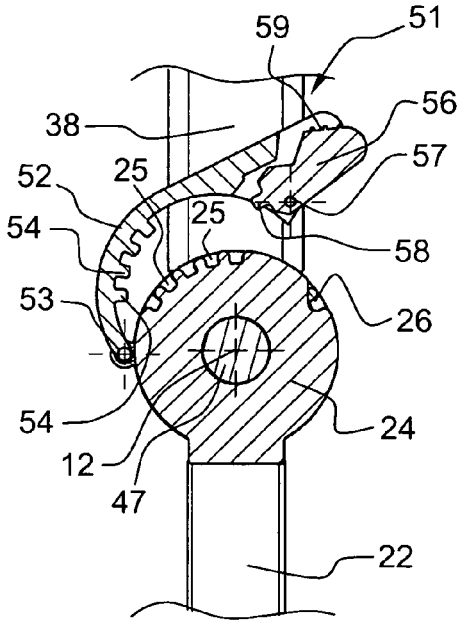
FIG. 3*b* a cross-sectional view similar to that of FIG. 3*a* but with the locking device in its release position.
Figure 4A:
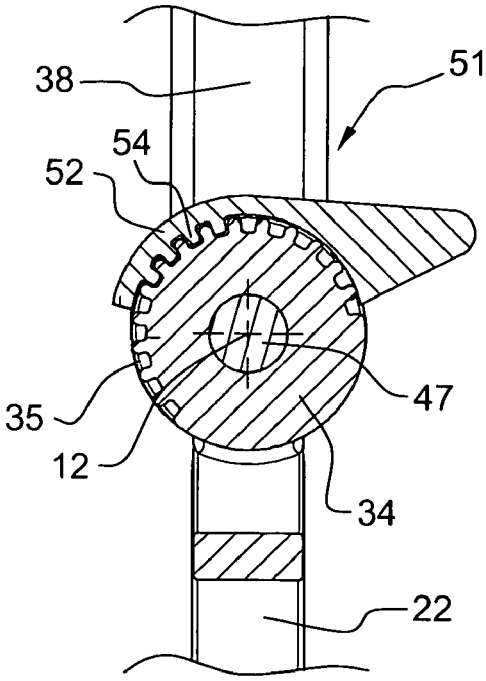
FIG. 4*a* a cross-sectional view along line IV-IV in FIG. 2 of the auxiliary handle with the locking device in its locking position.
Figure 4B:
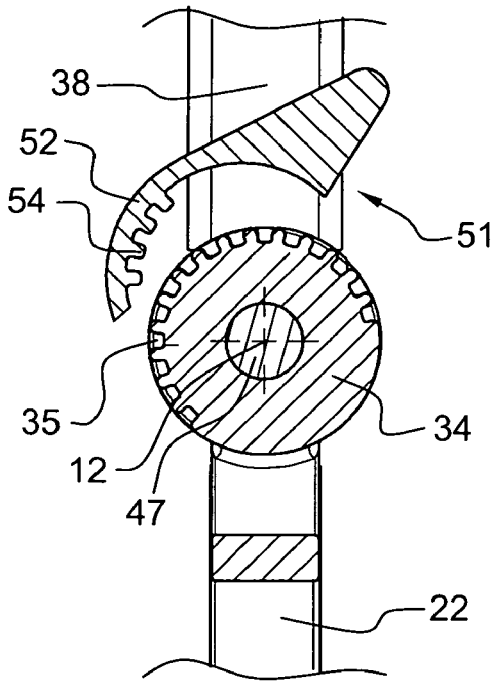
FIG. 4*b* a cross-sectional view similar to that of FIG. 4*a* but with the locking device in its release position.

A hand-held power tool 7, which is shown in FIG. 1, includes an auxiliary handle 11 according to the present invention that is formed as a side handle and is releasably secured on a cylindrical section 8 of the power tool 7. The auxiliary handle 11 has a gripping member 31 for grasping and holding the auxiliary handle 11 and pivotable about a pivot axis 12 toward an operational axis 9 of the power tool 7 to adapt to the gripping position on the power tool 7, when needed.

The auxiliary handle 11, which is shown in detail in FIGS. 2-4*b*, has an attachment section 21 for securing the auxiliary handle 11 on the power tool 7 and two, pre-loaded against each other, clamping sections 22. The clamping sections 22 are securable on the cylindrical section 8 by a clamping device 23 formed by a clamping screw and a nut. In a loosened position of the clamping sections 22, the auxiliary handle 11 is pivotable about the operational axis 9 of the power tool 7 or can be removed from the power tool 7. The attachment section 21 has an articulation section 24. The gripping member 31 of the auxiliary handle 11 is essentially U- or D-shaped and has a base 32 and two legs 33 and 38 projecting from the base 32. On the leg 33, there is provided a first bearing section 34 adjacent to the second leg 38, and on the leg 38, there is provided a second bearing section 39 adjacent to the leg 33.

Between the attachment section 21 and the gripping member 31, there is provided a lockable lag hinge 46 having a pivot pin 47 having a longitudinal axis that forms the pivot axis 12. The pivot pin 47 extends through the articulation section 24 and both bearing sections 34 and 39, so that these sections form articulation sleeves of the lag hinge 46.

There is further provided a locking device 51 for locking or releasing the lag hinge 46. The locking device 51 has a locking member 52 pivotable about an axis 53 extending parallel to the pivot axis 12 and pivotable between a locking position in which the lag hinge 46 is locked, and a release position in which the lag hinge is released. The locking member 52 is supported on the articulation section 24 of the attachment section 21. The axis 53 is formed by a pivot pin extending parallel to the pivot axis 12.

The locking member 52 has, in the extension direction of the pivot axis 12, a width B which is greater than the width of the articulated section 24 in the same direction. The locking member 52 extends beyond the articulation section 24 on both sides of the articulation section 24. In the locking position of the locking member 52, it bears against the articulation section 24 of the attachment section 21, on one hand, and against edge regions of both bearing sections 34 and 39, on the other hand.

The locking member 52 has four locking elements 54 formed as projecting cams. In the locking position of the locking member 52, the locking elements 54 engage in four of fifteen counter-locking elements 35 formed as recesses in the bearing sections 34 and 39 of the gripping member 31, and engage in four of five counter-locking elements 25 formed as recesses in the articulation section 24 of the attachment section 21 in accordance with orientation of the gripping member 31 relative to the attachment section 21. The counter-locking elements 25 and 35 are circumferentially and radially spaced from each other in a respective grid. The locking elements 54 are likewise correspondingly spaced from each other in a grid corresponding to the grids of the counter-locking elements 25 and 35. The locking means 54 extend essentially over the entire width B of the locking member 52. When the counter-locking elements 25 and 35 are arranged in a line, then a locking element 53 simultaneously engage in respective counter-locking element 25 and counter-locking element 35 in a locking position of the locking member 52.

On the locking member 52, there is further provided a safety element 56 for securing the locking member 52 in its locking position. The safety element 56 is pivotally secured at a pivot point 57 provided on the locking member 52 and engages in, its safety position, with a projection 58 provided on the safety element 56, in a safety groove 26 provided on the articulation section 24 of the attachment section 21. The safety element 56 is so arranged on the locking member 52 that without a manual pivotal movement of the safety element 56 about its operational section 59, at an inadvertent lifting of the locking member 52 off the articulation section 24 of the attachment section 21, the safety elements 56 counter-acts the lifting-off of the locking member 52. Thereby, an advantageous locking of the locking member 52 in its locking position is insured.

For pivoting the gripping member 31 relative to the attachment section 21, firstly, the safety element 56 is displaced in its releasing position in which the locking member 52 can be pivoted about its axis 53 away from the articulation section 24 of the attachment section 21. Thereby, the engagement of the locking elements 54 with the counter-locking elements 25 and 35 on the articulation section 24 and the bearing sections 34 and 39, respectively, is lifted off. As a result, the locking member 52 is in its release position in which the lag hinge 46 is released, so that pivoting of the gripping member 31 relative t to the attachment section 21 becomes possible.

For a new locking of the lag hinge 46, the locking member 52 is again pivoted toward the articulation section 24 of the attachment section 21 so that, with a corresponding alignment of the counter-locking elements 35 on the bearing sections 34 and 39 and with the counter-locking elements 25 on the articulation section 24, the locking elements 54 again engage the counter-locking elements 25 and 35. The locking member 52 occupies its locking position in which the lag hinge is locked.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An auxiliary handle for a hand-held power tool (7), comprising:

an attachment section (21) for securing the auxiliary handle (11) on a section (8) of the power tool (7) and having an articulation section (24);

a gripping member (31) for holding the auxiliary handle (11) and having at least one bearing section (34, 39);

a lockable lag hinge (46) provided between the attachment section (21) and the gripping member (31) and pivotable about a pivot axis (12) between a locked position in which the lag hinge (46) is locked between the gripping member (31) relative to the attachment section (21) blocking a pivotal movement of the gripping member (31) and the attachment section (21), and a released position in which the lag hinge (46) is able to pivot about the pivot axis (12) between the gripping member (31) and the attachment section (21) enabling the pivotal movement of the gripping member (34) relative to the attachment section (21); and a locking device (51) for locking and releasing the lag hinge (46) and including a locking member (52) operatively connected with at least one of gripping member (31) and the attachment section (21) and pivotable about an axis (53) extending parallel to the axis (12) of the lag hinge (46) between a locking position thereof in which the lag hinge (46) is in the locked position thereof, and a release position thereof in which the lag hinge (46) is in the released position thereof, wherein the locking member (52) includes a safety element (56) for securing the locking member (52) in the locking position thereof.

2. An auxiliary for a hand-held power tool (7), comprising:

an attachment section (21) for securing the auxiliary handle (11) on a section (8) of the power tool (7) and having an articulation section (24);

a gripping member (31) for holding the auxiliary handle (11) and having at least one bearing section (34, 39);

a lockable lag hinge (46) provided between the attachment section (21) and the gripping member (31) and pivotable about a pivotal axis (12) between a locked position in which the lag hinge (46) is locked between the gripping member (31) relative to the attachment section (21) blocking a pivotal movement of the gripping member (31) and the attachment section (21), and a released position in which the lag hinge (46) is able to pivot about the pivot axis (12) between the gripping member (31) and the attachment section (21) enabling the pivotal movement of the gripping member (31) relative to the attachment section (21); and a locking device (51) for locking and releasing the lag hinge (46) and including a locking member (52) operatively connected with at least one of gripping member (31) and the attachment section (21) and pivotable about an axis (53) extending parallel to the axis (12) of the lag hinge (46) between a locking position thereof in which the lag hinge (46) is in the locked position thereof, and a release position thereof in which the lag hinge (46) is in the released position thereof, wherein the locking member (52) is supported on the articulation section (24) of the attachment section (21).

3. An auxiliary handle for a hand-held power tool (7), comprising:

an attachment section (21) for securing the auxiliary handle (11) on a section (8) of the power tool (7) and having an articulation section (24);

a gripping member (31) for holding the auxiliary handle (11) and having at least one bearing section (34, 39);

a lockable lag hinge (46) provided between the attachment section (21) and the gripping member (31) and pivotable about a pivotal axis (12) between a locked position in which the lag hinge (46) is locked between the gripping member (31) relative to the attachment section (21) blocking a pivotal movement of the gripping member (31) and the attachment section (21), and a released position in which the lag hinge (46) is able to pivot about the pivot axis (12) between the gripping member (31) and the attachment section (21) enabling the pivotal movement of the gripping member (31) relative to the attachment section (21); and a locking device (51) for locking and releasing the lag hinge (46) and including a locking member (52) connectable with the gripping member (31) and pivotable about an axis (53) extending parallel to the axis (12) of the lag hinge (46) between a locking position thereof in which the lag hinge (46) is in the locked position thereof, and a release position thereof in which the lag hinge (46) is in the released position thereof, wherein the locking member (52) includes a locking means (54) that cooperates, in the locking position of the locking member (52), with counter-locking means (35) provided on the at least one bearing section (34, 39) of the gripping member (31).

4. An auxiliary handle according to claim 3, wherein the articulation section (24) of the attachment section (21) is likewise provided with counter-locking means (25) with which the locking means (54) of the locking member (52) cooperates in the locking position of the locking member (52).

5. An auxiliary handle according to claim 4, wherein the locking means (54) of the locking member (52) has cams and the counter-locking means (25, 35) of the articulation section (24) and of the at least one bearing section (34, 39) has corresponding recesses for receiving the cams.

6. An auxiliary handle according to claim 4, wherein the counter-locking means (25, 35) of both the articulation section (24) of attachment section (21) and of the at least one bearing section (34, 39) of the gripping member (31) comprises a plurality of counter-locking elements radially circumferentially spaced from each other and provided in a grid.

* * * * *